US009771528B2

(12) United States Patent
Ancheyta Juárez et al.

(10) Patent No.: US 9,771,528 B2
(45) Date of Patent: Sep. 26, 2017

(54) HYDROPROCESSING OF HEAVY HYDROCARBONS USING LIQUID QUENCH STREAMS

(75) Inventors: Jorge Ancheyta Juárez, Delegación Gustavo A. Madero (MX); Anton Alvarez Majmutov, Delegación Gustavo A. Madero (MX); Gustavo Jesús Marroquín Sánchez, Delegación Gustavo A. Madero (MX); Guillermo Centeno Nolasco, Delegación Gustavo A. Madero (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 890 days.

(21) Appl. No.: 12/720,914

(22) Filed: Mar. 10, 2010

(65) Prior Publication Data

US 2010/0230323 A1 Sep. 16, 2010

(30) Foreign Application Priority Data

Mar. 11, 2009 (MX) ..... MX/a/2009/002645

(51) Int. Cl.
*C10G 65/04* (2006.01)

(52) U.S. Cl.
CPC ..... *C10G 65/04* (2013.01)

(58) Field of Classification Search
CPC ..... C10G 65/00; C10G 65/02; C10G 65/04; C10G 2300/4006
USPC ..... 208/59, 48 Q, 80; 585/263
See application file for complete search history.

(56) References Cited

U.S. PATENT DOCUMENTS

| | | | | |
|---|---|---|---|---|
| 3,425,810 | A | 2/1969 | Scott | |
| 3,489,674 | A | 1/1970 | Borst | |
| 3,728,249 | A | 4/1973 | Antezana et al. | |
| 5,290,427 | A | 3/1994 | Fletcher et al. | |
| 5,492,617 | A * | 2/1996 | Trimble et al. | 208/148 |
| 5,603,824 | A * | 2/1997 | Kyan et al. | 208/208 R |
| 6,299,759 | B1 | 10/2001 | Bradway et al. | |
| 6,583,186 | B2 | 6/2003 | Moore | |
| 6,589,415 | B2 | 7/2003 | Smith et al. | |
| 6,656,342 | B2 | 12/2003 | Smith et al. | |
| 7,014,750 | B2 | 3/2006 | Boger et al. | |
| 8,764,970 | B1 * | 7/2014 | Moore | 208/48 Q |
| 2002/0144930 | A1 * | 10/2002 | Moore, Jr. | 208/108 |
| 2003/0010678 | A1 | 1/2003 | Kalnes | |

(Continued)

*Primary Examiner* — Michelle Stein
(74) *Attorney, Agent, or Firm* — Dickinson Wright PLLC

(57) ABSTRACT

A process for reducing sulfur, nitrogen, metals and asphaltene contents, while increasing the yield of distillable fractions in heavy hydrocarbons, by using a cooled light fraction as a liquid quench stream. The light fraction is obtained by splitting heavy hydrocarbons into a heavy fraction, and a light fraction which may be injected at spaced locations along a system of fixed-bed reactors series that comprises a first hydrodemetallization (HDM)/hydrodeasphaltenization (HDAs) step, followed by a second hydrodesulfurization (HDS)/hydrodenitrogenation (HDN)/hydrocracking step. The metal and asphaltene rich heavy fraction have contact with the entire catalyst system, while the light fraction is injected as side feed and quench stream(s) into the second reactor, where it is treated in admixture with the heavy fraction for elimination of the impurities of the light fraction.

14 Claims, 1 Drawing Sheet

(56) References Cited

U.S. PATENT DOCUMENTS

| | | | | |
|---|---|---|---|---|
| 2005/0006279 | A1* | 1/2005 | Gueret | C10G 69/04 208/86 |
| 2006/0144754 | A1* | 7/2006 | Van Den Bosch | C10G 9/007 208/92 |
| 2007/0187294 | A1* | 8/2007 | Ancheyta Juarez et al. | 208/58 |

* cited by examiner

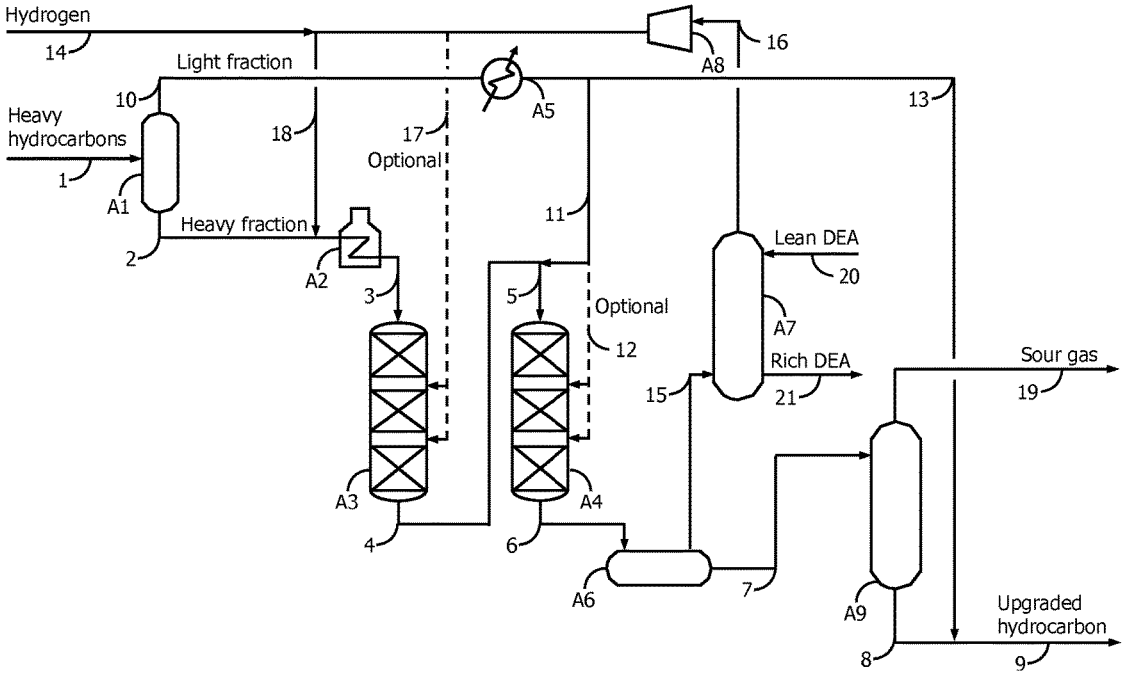
Hydrogen
14
Light fraction
10
Heavy hydrocarbons
1
A1
Heavy fraction
2
18
17
Optional
A2
3
A3
4
A5
11
5
Optional
12
A4
6
A6
7
A8
16
13
Lean DEA
20
A7
Rich DEA
21
15
Sour gas
19
A9
8
Upgraded hydrocarbon
9

HYDROPROCESSING OF HEAVY HYDROCARBONS USING LIQUID QUENCH STREAMS

CROSS-REFERENCE TO RELATED APPLICATION

This application claims the benefit under 35 U.S.C. §119 of Mexican Patent Application No. PA/a/2009/002645, filed Mar. 11, 2009, which is hereby incorporated by reference in its entirety.

TECHNICAL FIELD OF THE INVENTION

The present invention relates to a hydroprocessing process for reducing sulfur, nitrogen, metals and the asphaltene content of heavy hydrocarbons, while increasing the yield of distillable fractions, by using liquid quench streams, thereby providing a better quality feedstock to refining processes.

More particularly, heavy hydrocarbons having an API gravity below 32°, such as: heavy and extra heavy crude oils, residues, and their blends with light crude oils, can be hydroprocessed by the process of the present invention.

BACKGROUND OF THE INVENTION

Over the last years the demand for high value petroleum products such as gasoline, diesel and jet fuel have been increasing, while the supply of light crudes has been declining, which has been offset by the production of heavy crudes. Heavy crude oils and residua are characterized by exhibiting high content of contaminants such as sulfur, nitrogen, metals and asphaltenes, besides having low yield of distillable fractions. These trends along with the nature of heavy oils emphasize the importance of processes to convert such streams into lighter and cleaner ones.

Catalytic hydroprocessing is one of the most used approaches to upgrade heavy oils and residua due to its flexibility for handling different petroleum fractions. During hydroprocessing of heavy fractions various reactions occur, such as hydrodemetallization (HDM), hydrodesulfurization (HDS), hydrodeasphaltenization (HDAs), hydrodenitrogenation (HDN) and hydrocracking, depending on the reaction system, type of catalyst and severity of the reaction. Commonly, down-flow fixed-bed reactors are employed for hydroprocessing. The reactor(s) are sequentially loaded with a series of catalysts (CoMo/NiMo) with different functionalities. The catalyst system in fixed-bed heavy oil hydroprocessing is generally composed of different types of catalysts designed for specific objectives such as HDS, HDM, HDN, mild hydrocracking (MHC) and Conradson Carbon (CCR) removal.

The main problem with fixed-bed heavy hydrocarbon hydroprocessing is the poisoning and fouling of the catalyst bed over time. To achieve economically acceptable catalyst cycle lives, commonly HDM guard reactors have been used to protect down stream catalysts; another option is to tailor the operating conditions in order to keep at low levels the catalyst deactivating reactions such as HDM and coking, such an operation implies keeping a balanced reactor pressure and temperature, the latter being the most essential variable for achieving an acceptable catalyst cycle length and the required product quality.

Hydroprocessing reactions are exothermic in nature, reason why an appropriate temperature control system is required. Commonly, the required reactor temperature profile is adjusted by dividing the total catalyst volume into several beds separated by inter-bed zones that allow introducing and mixing quench streams. Traditionally, hydrogen has been the quench fluid of choice in most of these processes; however, liquid quenching is also practiced.

Hydrogen quenching has the advantage of replenishing hydrogen consumption of the preceding bed and diluting the concentration of hydrogen sulfide and ammonia; its availability depends on the hydrogen-to-oil ($H_2$/oil) ratio along the reactors, which depends primarily on the compressor capacity within the plant. High $H_2$/oil ratios increase quench availability, however, also increase compressor requirements, besides increasing superficial gas velocity across the reactor, which can produce excessive pressure drops.

When hydrogen quenching is limited, liquid quenching, particularly with cold hydrocarbon streams, can be advantageous due to their higher heat capacity and lower compression cost. Various liquid quench based process schemes have been proposed, such schemes can be classified into split- or multiple-feed processes and product recycle processes.

The split-feed processes are characterized by previously fractionating the feed and introducing each fraction into the reactor in descendent order of boiling ranges, from the top of the reactor to the last bed at the bottom, in such a way that the light fractions act as quench streams and also are processed in the following catalytic bed.

In the case of product recycle processes, a previously cooled portion of the reactor effluent is recycled in order to be used as quench stream and to provide a second pass opportunity to unreacted species.

The following patent documents describe split-feed processes:

- U.S. Pat. No. 3,728,249 (Antezana et al.) proposes a method for introducing middle distillates with different compositions into a multi-bed hydrotreating reactor;
- U.S. Pat. No. 5,290,427 (Fletcher et al.) provides a method for upgrading FCC gasoline, which involves separating the feed into a light olefin rich fraction and a heavy sulfur rich fraction, in order to introduce the heavy fraction at the top of the reactor for an extended contact time, whereas the light fraction is introduced towards the end of the reactor for reducing olefin saturation;
- U.S. Pat. No. 5,603,824 (Kyan et al.) reveals a process for upgrading waxy hydrocarbon streams in a multi-bed reactor by subjecting the heavy fraction of the feed to hydrocracking and dewaxing in the top bed of the reactor, and the light fraction, in admixture with the bed effluent from the top bed, to hydrodesulfurization in the subsequent beds;
- U.S. Pat. No. 6,299,759 (Bradway et al.) discloses an alternative method for quenching hydrotreating reactors by splitting the liquid feed into several streams of the same composition in order to be injected at several lengths of the reactor;
- U.S. Pat. No. 6,583,186 (Moore), U.S. Pat. No. 6,589,415 (Smith et al.), and U.S. Pat. No. 6,656,342 (Smith et al.) provide process schemes for hydroprocessing Fischer-Tropsch products comprising liquid quenching; in this case, the heavy fraction is subjected to hydrocracking conditions at the top beds of the reactor, whereas the rest of the fractions are subjected to hydrodesulfurization in the following beds; and
- U.S. Patent Publication No. 2003/0010678 (Kalnes) proposes a method for vacuum gasoils, comprising a first HDS/HDN stage, in which lighter hydrocarbons are used for quenching, followed by a HCR stage.

As for the product recycling processes, the following patent documents are available:

- U.S. Pat. No. 3,425,810 (Scott) proposes several schemes for introducing and withdrawing liquid streams between catalyst beds in order to provide stripping to these streams and/or to reintroduce them, after being previously cooled, as quench;
- U.S. Pat. No. 3,489,674 (Borst) reveals a method for hydroprocessing hydrocarbons characterized by recycling part of the liquid product stream as quench;
- U.S. Pat. No. 5,492,617 (Trimble et al.) illustrates a quenching method for an upflow reactor for the hydroprocessing of heavy hydrocarbons; and
- U.S. Pat. No. 7,014,750 (Boger et al.) provides a method to hydrogenate pyrolysis gasoline, in which a recycle stream of hydrogenated gasoline is employed as quench.

The processes based on liquid quenching do not disclose nor suggest their application to the hydroprocessing of heavy hydrocarbons, such as heavy and extra heavy crude oils, residues, and their blends with light crude oils, because the are difficult to handle with.

SUMMARY OF THE INVENTION

The process of the present invention involves splitting heavy hydrocarbons into a heavy fraction and a light fraction which light fraction may be injected at spaced locations along a system of fixed-bed reactors series that comprises a first hydrodemetallization (HDM)/hydrodeasphaltenization (HDAs) step, followed by a second hydrodesulfurization (HDS)/hydrodenitrogenation (HDN)/hydrocracking step, thereby optimizing use of the equipment and catalyst performance. The process of the present invention allows the metal and asphaltene rich heavy fraction to have contact with the whole catalyst system, and the light fraction to be injected as side feed and quench stream(s) into the second reactor, where it is provided with treatment in admixture with the heavy fraction in places where it is more suitable for the impurities of the light fraction to be eliminated.

With the process of the present invention, catalytic activities of HDM, HDAs, HDS, and HDN, of at least 65, 43, 70, and 44%, respectively, are achieved, producing upgraded hydrocarbons with an API gravity at least 8°, considerably lower viscosity, liquid yield at least 3 vol % higher, and conversion of 538° C.+ residue of at least 15 vol %.

The process of the present invention provides improved hydroprocessing of heavy hydrocarbons by using liquid quench streams, and also provides a process that differs considerably in the type of feedstock, operating conditions, and the characteristics of the product previously achieved.

According to one embodiment, the present process reduces sulfur, nitrogen, metals and asphaltene contents, while increasing the yield of distillable fractions in heavy hydrocarbons, by hydroprocessing using liquid quench streams, to provide a better quality feedstock to refining processes.

According to another embodiment of the present invention, the present hydroprocessing process can be used for heavy hydrocarbons that exhibit API gravity below 32°, such as: heavy and extra heavy crude oils, residues, and their blends with light crude oils.

BRIEF DESCRIPTION OF THE DRAWING OF THE INVENTION

FIG. 1 is a schematic representation of the process of the present invention.

DETAILED DESCRIPTION OF THE INVENTION

The present invention provides a method for the upgrading heavy hydrocarbons using hydroprocessing with liquid quenching. More specifically, the present invention is related to a process for reducing sulfur, nitrogen, metals and asphaltene contents, while increasing the yield of distillable fractions in heavy hydrocarbons, by its hydroprocessing using liquid quench streams, thereby providing a better quality feedstock to refining processes.

The process involves splitting the heavy hydrocarbons into a heavy fraction and a light fraction in order to be injected at spaced locations along a fixed-bed reactor system that comprises a first hydrodemetallization (HDM)/hydrodeasphaltenization (HDAs) step, followed by a second hydrodesulfurization (HDS)/hydrodenitrogenation (HDN)/hydrocracking step, optimizing in this way the use of the equipment and catalyst performance. The process scheme of the present invention allows the metal and asphaltene rich heavy fraction to have contact with the whole catalyst system, and the light fraction to be injected as side feed and quench stream(s) into the second reactor, where it is provided with treatment in admixture with the heavy fraction in places where it is more suitable for the impurities of the light fraction to be eliminated. This is possible owing to the fact that the catalyst of the first reaction step is more porous in nature and is designed to process heavy molecules, therefore it would be pointless passing the lower molecular weight compounds of the light fraction through this catalyst because it would be unfeasible for them to react.

Feedstock

The feedstock to the process of the present invention comprises heavy hydrocarbons that exhibit API gravity below 32°, such as: heavy and extra heavy crude oils, residues, and their blends with light crude oils.

The Examples of the present invention use as feedstock heavy crude oils with API gravity below 13°, sulfur content above 5.0 wt %, nitrogen content above 4,750 wppm, metals content (Ni+V) above 550 wppm, asphaltene (content insolubles in $C_7$) above 17 wt %, and a yield of residue with a boiling range above 538° C. higher than 47 vol %.

The process involves splitting the heavy hydrocarbons to form two fractions. The cut point between the fractions can be between 280 and 400° C., preferably between 335 and 355° C., in order to obtain a light fraction with a boiling range from the initial boiling point (IBP) to the cut point, which comprises part or all distillable fractions at atmospheric conditions, and a heavy fraction with a boiling range above the cut point, which in the case of a cut point between 335 and 355° C. is an atmospheric residue. The physical and chemical properties of both fractions will vary depending on the crude or blend of crudes of origin. The fractions derived from the heavy crude used as feedstock in the Examples of the present invention include light fractions with API gravity below 40°, sulfur content above 2.0 wt % and nitrogen content above 200 wppm, and heavy fractions with API gravity below 6°, sulfur content above 5.0 wt %, nitrogen content above 5,500 wppm, metals content (Ni+V) above 700 wppm and asphaltene content (insolubles in $C_7$) above 20 wt %.

Process Configuration

The heavy hydrocarbons are separated into a light fraction and a heavy fraction with a cut point between 280 and 400° C., preferably between 335 and 355° C. The resulting fractions are treated by hydroprocessing in such a way that the heavy fraction is subjected to hydrodemetallization (HDM) and hydrodeasphaltenization (HDAs) conditions, optionally introducing hydrogen quench streams between the catalyst beds of this first reaction stage; the partially converted products from the first reaction step are then combined with a previously cooled light fraction stream to complement the quenching process of the high temperature products from the first reactor; the resulting combined fraction is subjected to hydrodesulfurization (HDS), hydrodenitrogenation (HDN), and hydrocracking conditions in a second reaction stage; optionally, additional light fraction streams can be employed to quench the inter-bed effluents of the second reactor.

The hydroprocessing of the heavy fraction is accomplished by feeding it to a first down-flow fixed-bed reactor under conditions where substantial metal and asphaltene elimination is achieved and at least a portion of the sulfur and nitrogen is removed. Under these process conditions, considerable amounts of heat are released, which is reflected in a sharp temperature rise along the reactor. Therefore, the reactor preferably must have multiple beds separated by inter-bed zones in order to inject quench streams, to limit the temperature increase. Hydrogen quenching is preferred in this first stage because such a stream partially replenishes hydrogen consumption and dilutes the concentration of hydrogen sulfide and ammonia in the gas phase, which is beneficial for reducing the inhibitory effects of these compounds on hydrotreating reactions in downstream catalytic beds. Injecting the light fraction as quench in the first reactor would be rather unpractical because the light fraction would increase space velocity and therefore would decrease reaction severity in this step of the process, which is unfavorable for metal and asphaltene removal. Additionally, since the catalyst type in the first reactor is designed mainly for processing heavy molecules, there would not be an appreciable removal of impurities from the light fraction.

The partially converted products from the first reaction step are then combined with a previously cooled light fraction stream to complement the quenching process of the high temperature products from the first reactor. Under the process conditions of temperature, pressure and $H_2$/oil ratio, there is partial vaporization of the light fraction. Partial vaporization minimizes the negative effect of space velocity increase, however, decreases hydrogen concentration in the gas phase. The resulting mixture enters to a second down-flow fixed-bed reactor where the content of sulfur and nitrogen is brought down substantially, whereas heavy hydrocarbons are converted into lighter ones by means of hydrocracking. Since the catalyst system employed in this second reaction step is designed for HDS/HDN, at least a portion of the sulfur and nitrogen species of the light fraction is removed. As in the first reaction step, the temperature rise must be limited by using multiple beds separated by inter-bed zones in order to inject quench streams. Optionally, additional light fraction streams can be employed to quench the inter-bed effluents of the second reactor, if due to temperature control of the reacting stream they are required.

The effluent of the second reactor is sent to a high pressure separator where the liquid products are recovered from the gases. The liquid stream from the high pressure separator is provided is sent to a stripping unit in order to remove the remaining dissolved hydrogen sulfide. The gas mixture from the high pressure separator is sent to a scrubbing unit in order to remove hydrogen sulfide and ammonia, and the resulting high hydrogen purity stream is recompressed and recycled to the reaction system. The sour gas free liquid stream is then mixed with the rest of the light fraction to obtain upgraded oil.

FIG. 1 illustrates the process of the present invention in a simplified manner. The FIGURE shows that the heavy hydrocarbons are fed through line 1 to separator A1 where they are divided into a light fraction with a boiling range from the initial boiling point (IBP) to the cut point, which can be between 280 and 400° C., preferably between 335 and 355° C., and a heavy fraction with a boiling range above this cut point. The heavy fraction that comes out from the bottom of separator A1 through line 2 is then mixed with hydrogen coming through line 18. The hydrogen/hydrocarbon mixture is heated to the reaction temperature between 320 and 450° C. in heater A2 and fed to the HDM/HDAs reactor A3 through line 3. Reactor A3 can have multiple catalytic beds separated by inter-bed zones to limit the temperature rise. It is recommended to use adequate reactor internals for distributing and mixing reactants in the inter-bed zones, as well at the top of the reactor. The hydrogen stream 17, coming from the hydrogen recycle stream 16, optionally can be introduced in to reactor A3 as quench.

The high temperature product intermediate that leaves reactor A3 through line 4 is cooled by combining it with light fraction stream 11, which is a portion of the light fraction coming from separator A1 through line 10 and previously cooled from the selected cut temperature to a temperature between 60 and 100° C., preferably between 70 to 100° C. in heat exchanger A5. The mixture enters reactor A4 through line 5 in order to be subjected to HDS/HDN/hydrocracking conditions. In this second reaction step, multiple beds separated by inter-bed zones are also preferred to limit temperature rise. Optionally, other light fraction stream can be injected through line 12 to quench the inter-bed effluents of reactor A4.

Product stream 6 that leaves reactor A4 is passed through high pressure separator A6 in order to recover the liquid hydrocarbons from the gas mixture. The liquid hydrocarbons coming from high separator A6 are sent through line 7 to stripping unit A9 in order to remove the remaining dissolved hydrogen sulfide. Gas stream 15 is fed to scrubbing unit A7, where it contacts a lean diethylamine (DEA) stream introduced by line 20, to produce a high purity hydrogen stream 16 and a hydrogen sulfide rich DEA stream 21. Stream 16 is recompressed in compressor A8 and optionally recycled to the reaction system as quench stream 17 and as hydrogen feed through line 18 after being mixed with hydrogen make up stream 14. The sour gas free liquid stream 8 is combined with the rest of the light fraction coming through line 13 in order to obtain upgraded oil represented by stream 9.

The process scheme of the present invention exhibits technical and economical improvements, which attribute competitive advantage to it for several reasons, among which are the following:

- The injection of a previously cooled light fraction stream provides quenching to the products from the first reactor.
- Quenching with liquid streams is preferable over using only hydrogen quenching because liquids have higher heat capacity and reduce compression costs.
- Quenching only with hydrogen requires large gas volumes and therefore large compressor capacity, and also has the disadvantage of increasing gas velocity in the subsequent catalytic beds leading to high pressure drops.
- Introducing the light fraction to the HDS/HDN zone provides treatment to such stream, removing at least a portion of sulfur and nitrogen species and improves the physical properties of the resulting hydrocarbon mixture, for instance viscosity and density, which increases penetration and contact with the catalyst particle.

Operating conditions such as reaction temperature, pressure and particularly $H_2$/oil ratio promote partial vaporization of the light fraction. Under the process conditions of the present invention, vaporizations of 60 to 80 vol % of hydrocarbons in the naphtha boiling range (IBP-204° C.) and of 50 to 70 vol % of hydrocarbons in the middle distillate boiling range (204-343° C.) can be expected. This is useful for concentrating the most refractory sulfur species contained in the middle distillate fraction in the liquid phase in order to be removed in the HDS/HDN zone, whereas the most reactive sulfur species are released to the gas phase and therefore have less contact with the catalyst. This aspect of the process is advantageous because the upgraded oil will contain middle distillate boiling range fractions with low content of refractory sulfur compounds, which contributes to the solution of the problem of ultra low sulfur diesel production. The sulfur species which were vaporized and therefore were had poor catalyst contacting can be easily removed in downstream hydrotreating units.

The injection position of the light fraction also exhibits a competitive advantage, using liquid quench streams increases progressively space velocity, which consequently decreases reaction severity, reason why the fact that the light fraction bypasses the HDM/HDAs zone allows keeping an adequate reaction severity in the present invention to maximize metals and asphaltene elimination.

Depending on the volume of recovered light fraction, the process allows for using additional streams the light fraction for quenching inter-bed effluents of the second reactor if other quench streams are not available.

Hydroprocessing

Operating conditions of both reaction steps of the process of the present invention include temperature, pressure, liquid hourly space velocity (LHSV) and $H_2$/oil ratio:

Reaction temperatures of 320 to 450° C. can be used, preferably of 350 to 450° C. Reaction temperature values are average bed values and will vary depending on the type of feed, desired conversion level and other process conditions. Therefore, the required inlet temperatures should be adjusted based on the expected temperature rises in order to obtain the adequate average temperatures. Since the process according to the present invention comprises two reactors in series, the inlet temperature of reactor two is adjusted by mixing the products from reactor one with a sufficient amount of light fraction. The temperature of the light fraction stream can be in the range of 60 to 100° C., preferably of 70 to 100° C.

Pressures of 40 to 130 kg/cm$^2$ can be employed, preferably of 45 to 90 kg/cm$^2$. This operation variable is important for balancing coking and HDM reactions, which allows maintaining an acceptable catalyst deactivation rate.

Values of LHSV based on the total catalyst volume and total feed volumetric flow rate of 0.2 to 3.0 h$^{-1}$ can be used, preferably of 0.2 to 2.0 h$^{-1}$.

$H_2$/oil ratios of 350 to 1,200 nl/l can be used, preferably of 450 to 1,050 nl/l.

The catalyst system loaded to fixed-bed reactors for residue and heavy oil hydroprocessing is generally composed of a number of catalysts designed for different purposes such as hydrotreating and hydroconversion. Such catalysts are made of transition metal sulfides dispersed on a high surface area support, with a typical composition of 3 to 15 wt % Group VIB metal oxide and 2 to 8 wt % Group VIII metal oxide. For the type of feeds described in the embodiments of the present invention, triple catalyst systems are suggested, comprising a front end HDM catalyst, a middle section balanced HDM/HDS catalyst, and a tail end highly active HDS/HDN/hydrocracking catalyst. The main feature of the front end catalyst is a deep penetration capacity and high metal storage capacity and its main function is to protect downstream catalysts by removing Ni, V and asphaltene molecules from the feed. The middle section provides additional metals elimination and partial HDS to produce a suitable quality feedstock for the tail end catalyst. Finally, the tail end catalyst is a catalyst that provides higher HDS and HDN, and promotes hydrocracking reactions in order to produce distillates.

Suitable catalysts for the reaction system of the present invention include HDM/HDAs catalysts with the majority of pores having pore diameter above 100 Angstrom and HDS/HDN catalysts that exhibit in the majority of the pores a pore diameter below 100 Angstrom. The catalysts can be composed by at least one hydrogenating metal from group VIB such as molybdenum and/or tungsten in oxide form, a promoter from group VIII such as nickel or cobalt also in oxide form, deposited on a catalytically active inorganic mixed oxide support, constituted mainly of gamma phase alumina combined with other carriers that can be oxides of titanium, zirconium, silicon or magnesium, and which can have additives such as phosphorus, boron or barium.

EXAMPLES

The process of the present invention is illustrated through the following examples, where the quality of the upgraded oil obtained with a conventional quenching scheme, in which only hydrogen quenching is employed, is compared with that of the upgraded oil obtained with a process scheme that employs only liquid quenching.

Both reaction stages of the process were tested in an isothermal pilot plant equipped with two fixed-bed reactors in series of equal size, equipped with the necessary hardware for inter-reactor hydrogen or liquid addition in order to provide quenching. The total reactor volume was sequentially loaded with a triple catalyst system with the following proportions: 30% front end HDM/HDAs catalyst, 30% middle section balanced HDM/HDS catalyst and 40% tail end HDS/HDN/hydrocracking catalyst.

The physical and chemical properties of the heavy crude oil employed as feedstock are presented in Table 1. After splitting the heavy crude oil, a light fraction and a heavy fraction were obtained, which properties and liquid yields are also presented in Table 1.

TABLE 1

| | Heavy crude oil | Light fraction | Heavy fraction |
|---|---|---|---|
| Boiling Range, ° C. | | 61-343 | 343+ |
| API Gravity | 12.93 | 39.8 | 5.4 |
| Viscosity, cSt | | | |
| 25.0° C. | 16555.0 | 2.07 | — |
| 37.8° C. | 4395.7 | 1.50 | — |
| 54.4° C. | 1289.3 | 1.07 | — |

TABLE 1-continued

| | Heavy crude oil | Light fraction | Heavy fraction |
|---|---|---|---|
| 121.0° C. | — | — | 1637.9 |
| C, wt % | 82.75 | 83.80 | 82.50 |
| H, wt % | 10.58 | 13.48 | 9.80 |
| Molar H/C | 1.524 | 1.917 | 1.410 |
| S, wt % | 5.19 | 2.05 | 5.74 |
| N, wppm | 4771 | 236 | 5960 |
| Metals, wppm | | | |
| Ni | 83 | 0 | 102 |
| V | 501 | 0 | 620 |
| Ni + V | 584 | 0 | 722 |
| Asphaltenes in $C_7$, wt % | 17.03 | 0 | 21.77 |
| 538° C.+ residue, vol % | 47.64 | 0 | 64.75 |
| Liquid yield, vol % | 100 | 26.12 | 73.88 |

Example 1

Quenching Only with Hydrogen

The heavy fraction with a boiling range above 343° C. was subjected to hydroprocessing conditions in the system of two fixed-bed reactors in series with inter-reactor hydrogen addition. The process was tested under the following conditions: temperature of 380 to 420° C., keeping constant the LHSV based on the total catalyst volume and heavy fraction feed volumetric flow rate at 0.25 $h^{-1}$, inlet $H_2$/oil ratio at 890 nl/l and pressure at 100 kg/cm$^2$. A hydrogen make-up stream was added between both reactors in order to provide hydrogen quenching. The rate of such a stream was kept at 17% of that of the main hydrogen feed, which is approximately 150 nl/l. The inter-reactor hydrogen stream replenishes a part of the consumed hydrogen in the first reactor, improves the profile of $H_2$/oil of the reaction system and dilutes the concentration of hydrogen sulfide and ammonia in the gas phase, which is beneficial for the reactions that take place in the second reactor. With the physical and chemical properties of the hydroprocessed heavy fraction and that of the unprocessed light fraction, considering plant mass balances and liquid yields, the properties of the upgraded oil were determined.

The physical and chemical properties of the obtained upgraded oil and the total catalytic activities of the quenching scheme that employs only hydrogen are presented in Table 2.

The results presented in Table 2 show the quality improvement of the heavy crude oil, when it is hydroprocessed using only hydrogen quenching, at 380, 400 and 420° C., as follows:

API gravity is substantially increased from 12.93° to 21.5, 24.5 and 27.5°, depending on reaction temperature, as a result of hydroconversion of the feed, which generates volumetric expansion of the liquid. This is also reflected in a considerable viscosity reduction and in the liquid yield which increases in 3.24, 4.22, and up to 4.67 vol %, at 380, 400, and 420° C., respectively.

Molar H/C ratio increases significantly from 1.524 to values between 1.616 and 1.731, which represents a quality improvement of the heavy hydrocarbon due to its hydrogenation.

TABLE 2

| | Reaction temperature, ° C. | | |
|---|---|---|---|
| | 380 | 400 | 420 |
| | Properties of the Upgraded Oil | | |
| API Gravity | 21.5 | 24.5 | 27.5 |
| Viscosity, cSt | | | |
| 25.0° C. | 233.82 | 46.34 | 14.43 |
| 37.8° C. | 109.16 | 25.90 | 9.07 |
| 54.4° C. | 48.52 | 14.00 | 5.56 |
| C, wt % | 86.35 | 86.79 | 86.50 |
| H, wt % | 11.71 | 12.16 | 12.57 |
| Molar H/C | 1.616 | 1.670 | 1.731 |
| S, wt % | 1.49 | 0.95 | 0.63 |
| N, wppm | 2,685 | 1,752 | 1,207 |
| Metals, wppm | | | |
| Ni | 39.7 | 26.5 | 9.1 |
| V | 118.4 | 64.5 | 23.1 |
| Ni + V | 158.1 | 91.1 | 32.2 |
| Asphaltenes in $C_7$, wt % | 9.47 | 5.05 | 1.58 |
| 538° C.+ residue, vol % | 37.21 | 31.39 | 21.88 |
| | Total Catalytic Activity | | |
| Liquid yield, vol % | 103.24 | 104.22 | 104.76 |
| HDS, % | 71.97 | 82.37 | 88.47 |
| HDN, % | 45.15 | 64.56 | 75.92 |
| HDM, % | 73.61 | 84.95 | 94.75 |
| HDAs, % | 45.83 | 71.40 | 91.20 |
| Conversion of 538° C.+, vol % | 19.36 | 31.32 | 51.89 |
| Hydrogen consumption, nl/l | 158 | 212 | 276 |

Sulfur content was reduced from 5.19 wt % to values between 0.63 and 1.49 wt %, which represents HDS levels between 72 and 89%.

Nitrogen content was reduced from 4,771 wppm to values between 1,207 and 2,685 wppm, which is reflected in HDN activities between 45 to 76%.

Substantial metals removal (Ni+V) can be appreciated, especially at higher temperatures; their concentration was reduced from 584 wppm to values between 32.2 and 158.1 wppm, which implies HDM of 74 to 95%. Nickel concentration was reduced from 83 wppm to values between 9.15 and 39.7 wppm, whereas vanadium was reduced from 501 wppm to values between 23.1 and 118.4 wppm.

Asphaltenes content was reduced from 17.03 wt % to values between 1.58 and 9.47 wt %, which stands for HDAs conversions of 46 to 91%.

Additionally, the upgraded oil presents yields of 538° C.+ residue between 22 and 37 vol %, which represents conversions between 19 and 52 vol %.

Finally, it is also shown that the total hydrogen consumption is between 158 and 276 nl/l.

As can be observed, higher reaction temperatures improve product quality, specially because API gravity is increased and viscosity, as well as the contents of sulfur, metals, asphaltenes and 538° C.+ residue, are reduced. However, the products formed by HDM and HDAs reactions are catalyst deactivating species, whereas conversion levels of 538° C.+ residue higher than 50% promote sludge formation, therefore, the rate of such reactions must be balanced by selecting an optimal reaction temperature in order to obtain economically acceptable catalyst cycle lives, besides the required product quality.

Example 2

Quenching Only with Liquids

The heavy fraction with a boiling range above 343° C. was subjected to hydroprocessing conditions in the system of two fixed-bed reactors in series with inter-reactor addition of the IBP-343° C. boiling range light fraction. The process was tested under the same conditions used in Example 1: temperature of 380 to 420° C., keeping constant the LHSV at 0.25 $h^{-1}$ based on the total catalyst volume and heavy fraction feed volumetric flow rate, inlet $H_2$/oil ratio at 890 nl/l and pressure at 100 kg/cm$^2$. The light fraction stream was injected in the inter-reactor section in order to generate a mixture with the products leaving the first reactor, thereby providing liquid quenching. The rate of the light fraction was kept at 10% of that of the heavy fraction feed, which is approximately at a LHSV=0.025 $h^{-1}$ based on the total catalyst volume and light fraction feed. Differently from Example 1, in which hydrogen is injected in the inter-reactor section, the injection of the light fraction has other effects on the conditions of the second reactor; at the process conditions of pressure, temperature and $H_2$/oil ratio, the light fraction is vaporized up to 70 vol affecting in this way the gas and liquid phases; the vaporized hydrocarbons dilute the concentration of hydrogen, hydrogen sulfide and ammonia in the gas phase; the remaining light fraction increases liquid flow rate and consequently LHSV, which decreases reaction severity in the second reactor; oppositely to Example 1, the light fraction decreases the $H_2$/oil ratio at the entrance of the second reactor; additionally, the light fraction contributes with sulfur and nitrogen compounds to the mixture that enters the second reactor and therefore, such species receive treatment in the second reaction step. Finally, the physical and chemical properties of the upgraded oil mixture were determined using the properties of the hydroprocessed mixture of heavy/light fraction and that of the unprocessed portion of light fraction, taking into account plant mass balances and liquid yields.

Table 3 shows the physical and chemical properties of the upgraded oil and the total catalytic activities according to the scheme that uses only liquid quenching of the present invention.

The results presented in Table 3 show the quality improvement of the heavy crude oil, when it is hydroprocessed using only liquid quenching, at 380, 400 and 420° C. (Example 2), in the same way in which the results of Example were reported in Table 2. The following results were obtained:

API gravity is also substantially increased from 12.93° to 20.8, 23.3 and 27.3°, which is slightly lower than the values obtained through the scheme of Example 1.

Viscosity is also decreased considerably, however, not at as much as in the scheme of Example 1.

Liquid yield also increases in 3.22 and 4.03 vol % at 380 and 400° C., respectively, which is respectively 0.03 and 0.20 vol % lower that the values obtained in Example 1; however, at 420° C. liquid yield increased and up to 5.04 vol %, which is 0.28 vol % higher than in Example 1.

Molar H/C ratio increases similarly as in Example 1, from 1.524 to values between 1.629 and 1.699.

Sulfur content also was reduced considerably from 5.19 wt % to values between 0.70 and 1.60 wt %, which represents HDS levels between 70 and 87%, and the same time represents an average 2% drop in HDS levels with respect to Example 1.

Nitrogen content also was reduced from 4,771 wppm to values between 1,307 and 2,743 wppm, which is reflected in HDN activities between 44 to 74%, and at the same time represents around 2% less HDN activity than in Example 1.

Substantial metals removal (Ni+V) also can be appreciated, their concentration was reduced from 584 wppm to values between 48.2 and 210.2 wppm, which implies HDM levels of 65 to 92%, which at the same time represents an average 6% drop in HDM with respect to Example 1. Nickel concentration was reduced from 83 wppm to values between 15.1 and 46.2 wppm, whereas vanadium was reduced from 501 wppm to values between 33.1 and 164 wppm.

Asphaltenes content also was reduced from 17.03 wt % to values between 1.56 and 9.87 wt %, which stands for HDAs conversions of 43 to 91%, and the same time represents an average 1.5% drop in HDAs with respect to Example 1.

In the same way, the upgraded oil presents yields of 538° C.+ residue between 24 and 39 vol %, which represents conversions between 15 and 47 vol %, which at same time averages 4% less conversion than obtained in Example 1.

Finally, lower catalytic activities of the process scheme of Example 2, are accompanied by lower hydrogen consumptions. In this case the process required 157, 204, and up to 258 nl/l, at 380, 400, and 420° C., respectively, whereas the process scheme of Example 1 required 158, 212, and up to 276 nl/l, at 380, 400, and 420° C., respectively.

In general, Examples 1 and 2 allow establishing the differences between a conventional hydroprocessing scheme, which uses only hydrogen quenching (Example 1), and scheme that uses only liquid quenching (Example 2). The obtained results assure that the product quality using hydroprocessing with liquid quenching to upgrade heavy crude oils does not differ substantially from a conventional hydrogen quenching scheme, which makes possible to use the advantages of liquid quenching in order reduce the problems associated to hydrogen quenching.

TABLE 3

| | Reaction temperature, ° C. | | |
|---|---|---|---|
| | 380 | 400 | 420 |
| | Properties of the Upgraded Oil | | |
| API Gravity | 20.8 | 23.3 | 27.3 |
| Viscosity, cSt | | | |
| 25.0° C. | 447.64 | 95.79 | 20.12 |
| 37.8° C. | 193.08 | 50.13 | 12.36 |
| 54.4° C. | 79.11 | 25.22 | 7.38 |
| C, wt % | 86.22 | 86.55 | 86.66 |
| H, wt % | 11.78 | 12.04 | 12.36 |
| Molar H/C | 1.629 | 1.657 | 1.699 |
| S, wt % | 1.60 | 1.12 | 0.70 |
| N, wppm | 2,743 | 1,944 | 1,307 |
| Metals, wppm | | | |
| Ni | 46.2 | 32.5 | 15.1 |
| V | 164 | 98.6 | 33.1 |
| Ni + V | 210.2 | 131.2 | 48.2 |
| Asphaltenes in $C_7$, wt % | 9.85 | 7.06 | 1.56 |
| 538° C.+ residue, vol % | 39.21 | 33.10 | 23.83 |
| | Total Catalytic Activity | | |
| Liquid yield, vol % | 103.22 | 104.03 | 105.04 |
| HDS, % | 69.81 | 79.05 | 87.18 |
| HDN, % | 43.70 | 60.45 | 73.81 |
| HDM, % | 64.77 | 78.20 | 92.11 |
| HDAs, % | 43.37 | 59.74 | 91.23 |
| Conversion of 538° C.+, vol % | 15.05 | 27.72 | 47.46 |
| Hydrogen consumption, nl/l | 157 | 204 | 258 |

What is claimed is:

1. A process for upgrading heavy hydrocarbons using hydroprocessing with liquid quenching that comprises:

a) splitting a heavy petroleum hydrocarbon feedstock having an API gravity below 13° and containing contaminants comprising asphaltenes, sulfur, nitrogen, and metals, at a cut-off point of 280-400° C. into a light fraction containing low molecular weight sulfur and nitrogen compounds and having an API gravity below 40°, and a heavy fraction containing high molecular weight sulfur, nitrogen, metal compounds and asphaltenes having an API gravity of below 6°, a sulfur content greater than 5 wt %, a nitrogen content above 5500 wppm, a total Ni and V content above 700 wppm and an asphaltene content of greater than 20 wt %;

passing the light fraction to a heat exchanger to form a cooled light fraction stream at a temperature of 60 to 100° C.;

b) mixing the heavy fraction with hydrogen to form a mixture, heating the mixture, and subjecting the mixture to a first reaction stage in a fixed-bed hydroprocessing reactor with multiple catalytic beds separated by inter-bed zones for hydrodemetallization (HDM) and hydrodeasphaltenization (HDAs) of the mixture, the multiple catalyst beds containing HDM/HDAs catalysts with a majority of pores having a pore diameter above 100 Angstroms, and injecting hydrogen into the inter-bed zones as a quench without introducing the light fraction into the inter-bed zones as an inter-bed quench in the fixed-bed hydroprocessing reactor used in the first reaction stage to reduce the total Ni and V content and obtain a partially converted fraction;

c) combining the high temperature partially converted fraction obtained from the first reaction stage with a portion of the cooled light fraction stream to form a combined fractions stream to complement quenching of the high temperature partially converted products from the first reaction stage;

d) passing the combined fractions stream to a second reaction stage in a fixed-bed hydroprocessing reactor with multiple catalytic beds separated by inter-bed zones, for hydrodesulfurization (HDS), hydrodenitrogenation (HDN), and hydrocracking to obtain a hydroprocessed liquid product; the multiple catalyst beds containing HDS/HDN catalysts with a majority of pores having a pore diameter below 100 Angstroms, and injecting a second portion of the cooled light fraction stream into the inter-bed zones as a quench; and e) combining the hydroprocessed liquid product from the second reaction stage with a remaining portion of the cooled light fraction stream to obtain an upgraded hydrocarbon.

2. The process of claim 1, wherein a plurality of cooled light fraction streams is employed to quench inter-bed effluents of the second reaction stage to control temperature of the reacting stream.

3. The process of claim 1, wherein the light fraction is cooled to a temperature of 70 to 100° C. before being introduced into the second reaction stage.

4. The process of claim 1, wherein the heavy hydrocarbon feedstock is selected from the group consisting of heavy crude oils, extra heavy crude oils, residues, and their blends with light crude oils.

5. The process of claim 1, wherein the first reaction step, comprising hydrodemetallization (HDM) and hydrodeasphaltenization (HDAs), is conducted at a temperature of 320 to 450° C., pressure of 40 to 130 kg/cm$^2$, liquid hourly space velocity (LHSV) based on a total catalyst volume and total liquid feed of 0.2 to 3.0 h$^{-1}$, and $H_2$/HC ratio of 350 to 1,200 nl/l.

6. The process of claim 1, wherein the second reaction stage, comprising hydrodesulfurization (HDS), hydrodenitrogenation (HDN), and hydrocracking, is carried out at a temperature of 320 to 450° C., pressure of 40 to 130 kg/cm$^2$, liquid hourly space velocity (LHSV) based on the total catalyst volume and total liquid feed of 0.2 to 3.0 h$^{-1}$, and $H_2$/HC ratio 350 to 1,200 nl/l.

7. The process of claim 1, wherein the cut-off point is between 335 and 355° C.

8. The process of claim 5, wherein said first reaction step is conducted at a temperature of 350 to 450° C., pressure of 45 to 90 kg/cm$^2$, liquid hourly space velocity (LHSV) based on the total catalyst volume and total liquid feed of 0.2 to 2.0 h$^{-1}$, and $H_2$/HC ratio of 450 to 1,050 nl/l.

9. The process of claim 6, wherein the second reaction stage, comprising hydrodesulfurization (HDS), hydrodenitrogenation (HDN), and hydrocracking, is carried out at a temperature of 350 to 450° C., pressure of 45 to 90 kg/cm$^2$, liquid hourly space velocity (LHSV) based on the total catalyst volume and total liquid feed of 0.2 to 2.0 h$^{-1}$, and $H_2$/HC ratio of 450 to 1,050 nl/l.

10. A process for upgrading heavy hydrocarbons which comprises:

a) splitting a heavy hydrocarbon feedstock containing contaminants comprising asphaltenes, sulfur, nitrogen, and metals, which comprise vanadium and nickel, and having an API gravity below 32° and selected from the group consisting of heavy crude oils, extra heavy crude oils, residues, and their blends with light crude oils; at a cut-off point between 280-400° C. into a light fraction having an API gravity below 40° and a heavy fraction having an API gravity below 6° containing asphaltenes, vanadium and nickel, passing the light fraction to a heat exchanger to form a cooled light fraction stream at a temperature of 60 to 100° C.;

b) mixing the heavy fraction with hydrogen to form a mixture, heating the mixture, and subjecting the heated mixture to a first reaction step in a fixed-bed hydroprocessing reactor with multiple catalytic beds for hydrodemetallization (HDM) and hydrodeasphaltenization (HDAs) of said mixture, injecting recycle hydrogen into the multiple catalyst beds as an inter-bed hydrogen quench without introducing the light fraction as quench into the multiple catalyst beds of the fixed-bed hydroprocessing reactor used in the first reaction stage to remove Ni, V and asphaltene to obtain a partially converted heavy fraction;

c) combining the partially converted heavy fraction from the first reaction step with a first portion of the cooled light fraction stream to complement the quenching process of the high temperature products from the first reactor;

d) subjecting the combined fractions to a second reaction stage in a fixed-bed hydroprocessing reactor with multiple catalytic beds, for its hydrodesulfurization (HDS), hydrodenitrogenation (HDN), and hydrocracking, injecting the multiple catalytic beds with one or more second portion of the cooled light fraction quench stream to quench the inter-bed effluents of the second reactor stage to control temperature of the reacting stream; and e) combining the hydroprocessed liquid product with the a remaining portion of cooled light fraction stream to obtain an upgraded hydrocarbon.

11. The process of claim 10, wherein said heavy hydrocarbon feedstock has an API gravity below 13°, a sulfur content above 5 wt %, an nitrogen content above 4,750 wppm, a total Ni and V content above 550 wppm, and an asphaltene content above 17 wt %.

12. The process of claim 11, wherein said heavy fraction has a sulfur content above 5 wt %, a nitrogen content above 5500 wppm, a total Ni and V content above 700 wppm and an asphaltene content above 20 wt %, and said light fraction has a sulfur content above 2 wt %, and a nitrogen content above 200 wppm.

13. The process of claim 11, wherein said process comprises removing a gas stream from the second reaction stage, separating hydrogen sulfide and ammonium from the gas stream, and recycling the resulting gas stream to the reaction process.

14. The process of claim 11, wherein said fixed bed reactors comprise a front end HDM catalyst, a middle section HDM/HDS catalyst, and a tail end HDS/HDN/hydrocracking catalyst.

* * * * *